US006460782B1

(12) United States Patent
Wang

(10) Patent No.: US 6,460,782 B1
(45) Date of Patent: Oct. 8, 2002

(54) SPRINKLER NOZZLE CAPABLE OF EMITTING WATER IN VARIOUS PATTERNS

(76) Inventor: Hsin-Fa Wang, No. 68, Mou Tan Lane Shao An Li, Lu Kang Town, Chang Hua Hsien (TW)

( * ) Notice: Subject to any disclaimer, the term of this patent is extended or adjusted under 35 U.S.C. 154(b) by 0 days.

(21) Appl. No.: 10/043,352

(22) Filed: Jan. 14, 2002

(51) Int. Cl.[7] ..... A62C 31/02; B05B 7/02

(52) U.S. Cl. ..... 239/390; 239/391; 239/392; 239/393; 239/394; 239/395; 239/396; 239/436; 239/525; 239/526

(58) Field of Search ..... 239/390, 391, 239/392, 393, 394, 395, 396, 397, 436, 437, 451, 455, 525, 526

(56) References Cited

U.S. PATENT DOCUMENTS 5,598,978 A * 2/1997 Wang ..... 239/394
5,772,121 A * 6/1998 Wang ..... 239/394
5,992,762 A * 11/1999 Wang ..... 239/394
6,164,566 A * 12/2000 Hui-Chen ..... 239/394
6,230,988 B1 * 5/2001 Chao ..... 239/394
6,286,767 B1 * 9/2001 Hui-Chen ..... 239/392
6,341,737 B1 * 1/2002 Chang ..... 239/394

* cited by examiner

*Primary Examiner*—Robin O. Evans
(74) *Attorney, Agent, or Firm*—Harrison & Egbert

(57) ABSTRACT

A sprinkler nozzle is formed of a main body, an inner cap, and an outer cap. The inner cap and the outer cap are fastened to the main body which is connected to the water source. The inner cap is provided with a plurality of water admission holes various in form. The outer cap is provided with a plurality of emission holes of various forms, two closing holes, and a number of mesh holes. Through the cooperation of the water admission holes of the inner cap and the emission holes, the closing holes, or the mesh holes of the outer cap, the sprinkler nozzle is capable of emitting water in various patterns.

1 Claim, 6 Drawing Sheets

SPRINKLER NOZZLE CAPABLE OF EMITTING WATER IN VARIOUS PATTERNS

BACKGROUND OF THE INVENTION

1. Field of the Invention

The present invention relates generally to a sprinkler system for watering a lawn, golf course, etc., and more particularly to a nozzle of the sprinkler system.

2. Description of Related Art

The conventional sprinkler nozzle is generally capable of emitting water in a specific pattern and is therefore limited in its use. For this reason, various sprinkler nozzles must be ready on hand to meet the need of a situation in which the water emission must be brought about in various patterns. It is time-consuming and frustrating for a user to sort out a desired sprinkler nozzle. In addition, various sprinkler nozzles must be purchased at an additional cost and provided with an additional storage space.

BRIEF SUMMARY OF THE INVENTION

The primary objective of the present invention is to provide a versatile sprinkler nozzle capable of emitting water in various patterns.

The sprinkler nozzle of the present invention comprises a main body, an inner cap, and an outer cap. The inner cap and the outer cap are held by the main body. The inner cap is provided with a plurality of water inlets of various forms, whereas the outer cap is provided with a plurality of water outlets of various forms and two closing holes. Through the cooperation of the water inlets of the inner cap with the water outlets and the closing holes of the outer cap, the sprinkler nozzle of the present invention is capable of emitting water in various patterns.

The features, functions, and advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
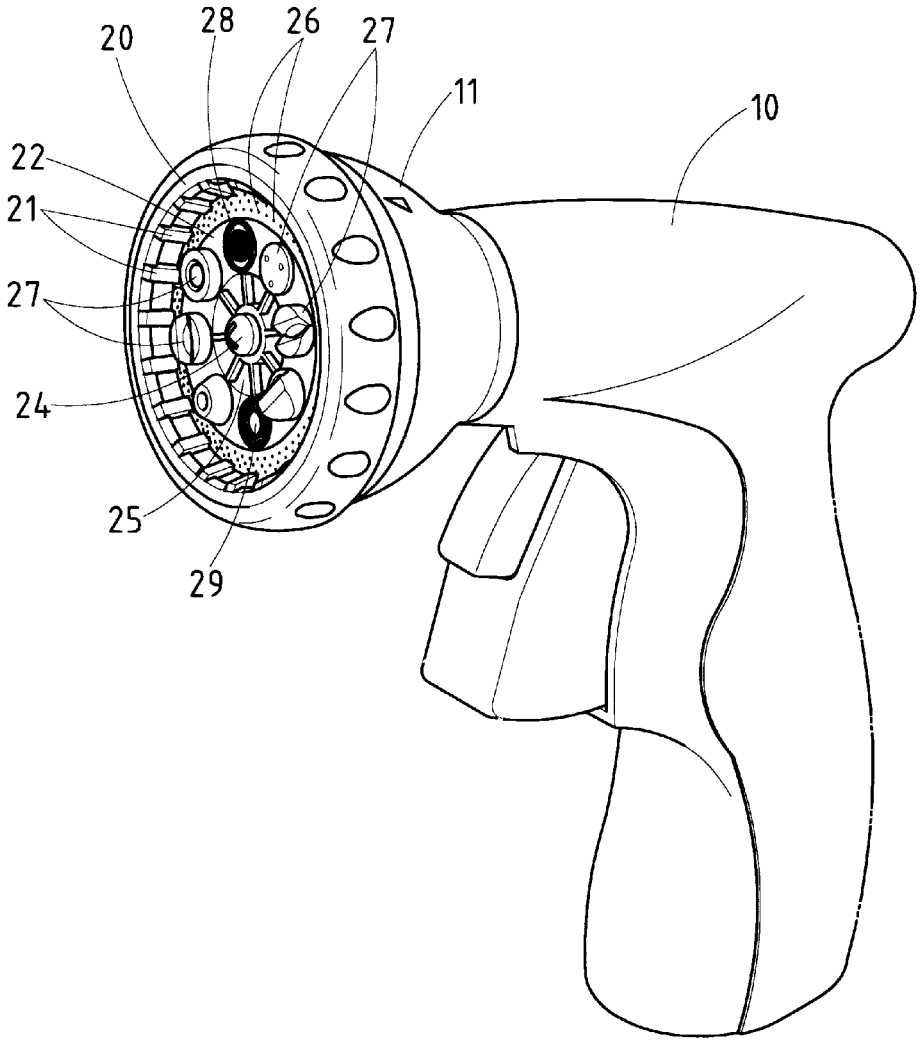
FIG. 1 shows a perspective view of the preferred embodiment of the present invention.
Figure 2:
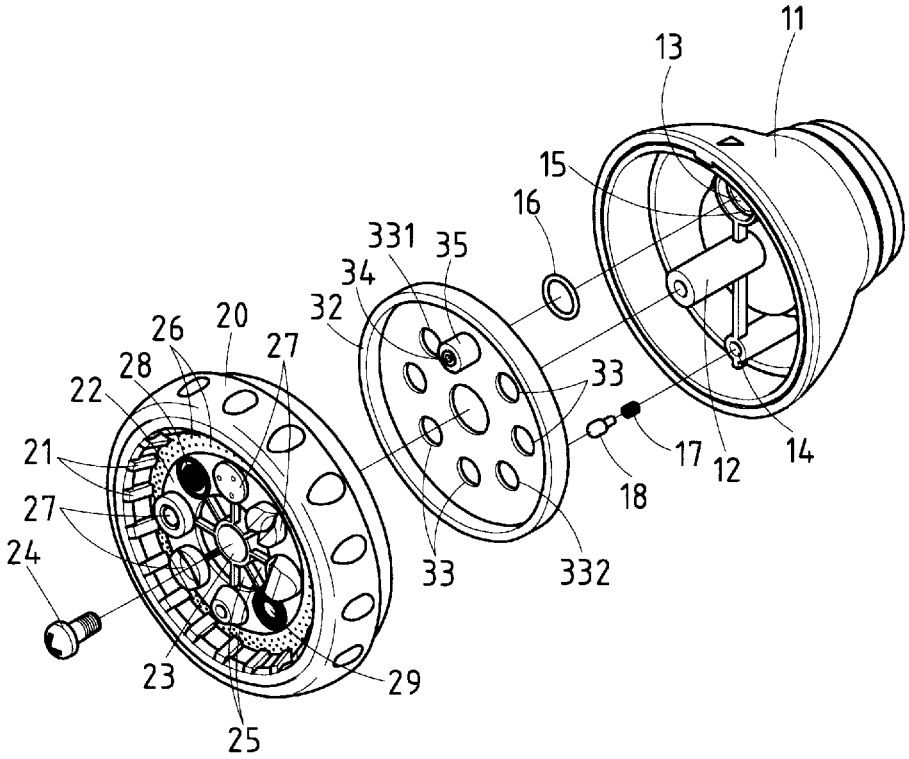
FIG. 2 shows an exploded perspective view of the preferred embodiment of the present invention.

As shown in all drawings provided herewith, a sprinkler nozzle of the present invention comprises a main body 10, an outer cap 20, and an inner cap 30.

The main body 10 has a head 11 which is provided in the hollow interior with a fastening rod 12, a water duct outlet 13, and a locating hole 14. The water duct outlet 13 is provided in the inner wall with an annular groove 15 for locating a washer 16. The locating hole 14 is provided therein with a spring 17 and an urging pin 18.

The outer cap 20 is provided in the periphery with a plurality of ribs 21, which are arranged in a radiating manner for connecting a disk 22. The disk 22 is provided with a through hole 23 corresponding in location to the fastening rod 12 of the main body 10. The outer cap 20 is fastened to the main body 10 in conjunction with a fastening bolt 24 such that the fastening-rod 12 of the main body 10 is put through the through hole 23 of the disk 22 of the outer cap 20. The disk 22 is provided with a plurality of central discharge holes 25 which are arranged in a radiating pattern such that the central discharge holes 25 circumvent the through hole 23 of the disk 22. The disk 22 is further provided in the periphery with a number of mesh holes 26. Located between the area of the mesh holes 26 and the central discharge holes 25 are six emission holes 27 and two closing holes 28 and 29. The emission holes 27 are circularly arranged and are different in form from one another. The emission holes 27 are provided with a hollow pillar 271 extending inwards therefrom. Similarly, the closing holes 28 and 29 are provided with a hollow pillar 281, 291. The hollow pillar 281 of the first closing hole 28 is provided with an indentation 282 in communication with the central discharge hole 25. The hollow pillar 291 of the second closing hole 29 is provided with a cut 292 in communication with the area of the mesh holes 26. The through hole 23 of the disk 22 of the outer cap 20 is provided with a stepped pillar 231 extending inwards, as shown in FIG. 3.

Figure 3:
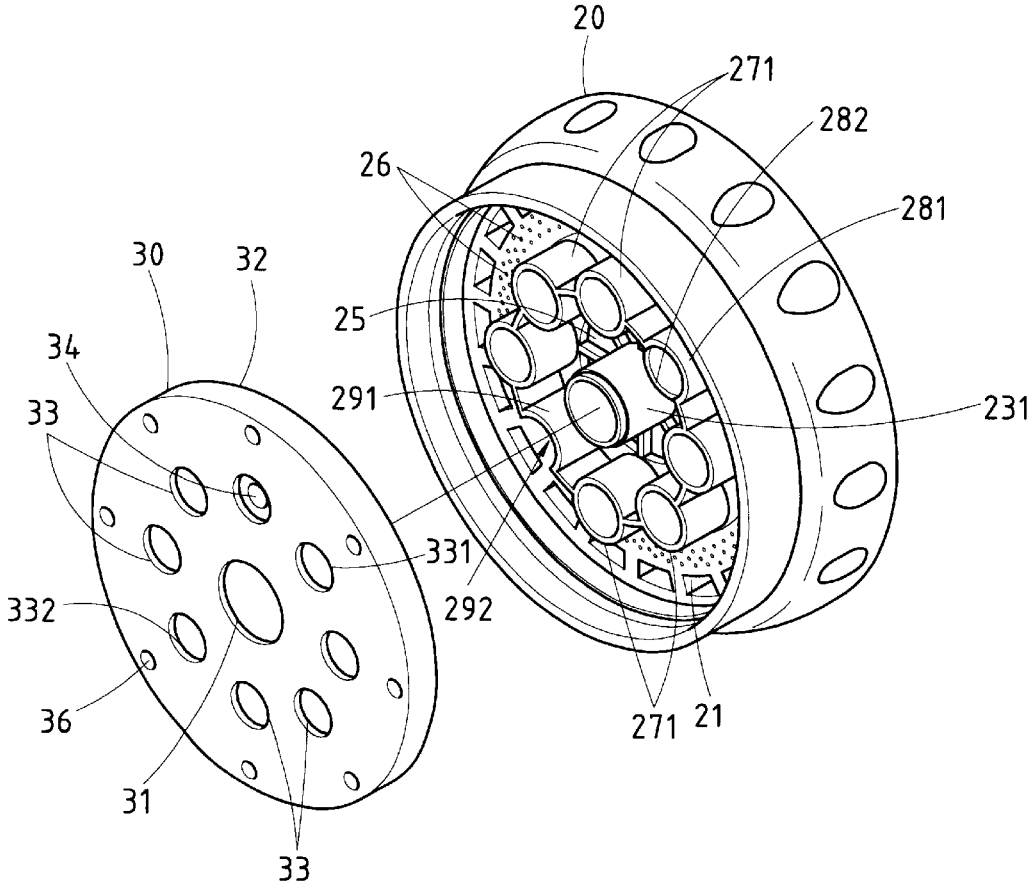
FIG. 3 shows a partial exploded view of the preferred embodiment of the present invention.

The inner cap 30 is provided with a through hole 31 and is disposed between the head 11 of the main body 10 and the outer cap 20 such that the stepped pillar 231 of the outer cap 20 is put through the through hole 31 of the inner cap 30, as shown in FIG. 3, and that an outer edge 32 of the front side of the inner cap 30 is rested against the fringe of the area of the mesh holes 26 of the disk 22 of the outer cap 20, and further that the outer edge 32 of the inner cap 30 is separated from the ribs 21 of the outer cap 20 by an appropriate distance. The inner cap 30 is provided with eight water admission holes 33, 331, 332, 34, which are corresponding in location to the emission holes 27 and the closing holes 28 and 29 of the outer cap 20. The water admission hole 34 is provided with a protruded tube 35 extending to join with the hollow pillar 271 of the emission hole 27 corresponding in location to the water admission hole 34, thereby enabling the inner cap 30 and the outer cap 20 to move synchronously. The inner cap 30 is provided in the periphery with a plurality of locating slots 36, as shown in FIG. 3. When the outer cap 20 and the inner cap 30 are rotated synchronously such that one of the water admission holes of the inner cap 30 is aligned with the water duct outlet 13 of the main body 10, the outer cap 20 and the inner cap 30 are located by the urging pin 18 which is received in one of the locating slots 36 of the inner cap 30.

Figure 4:
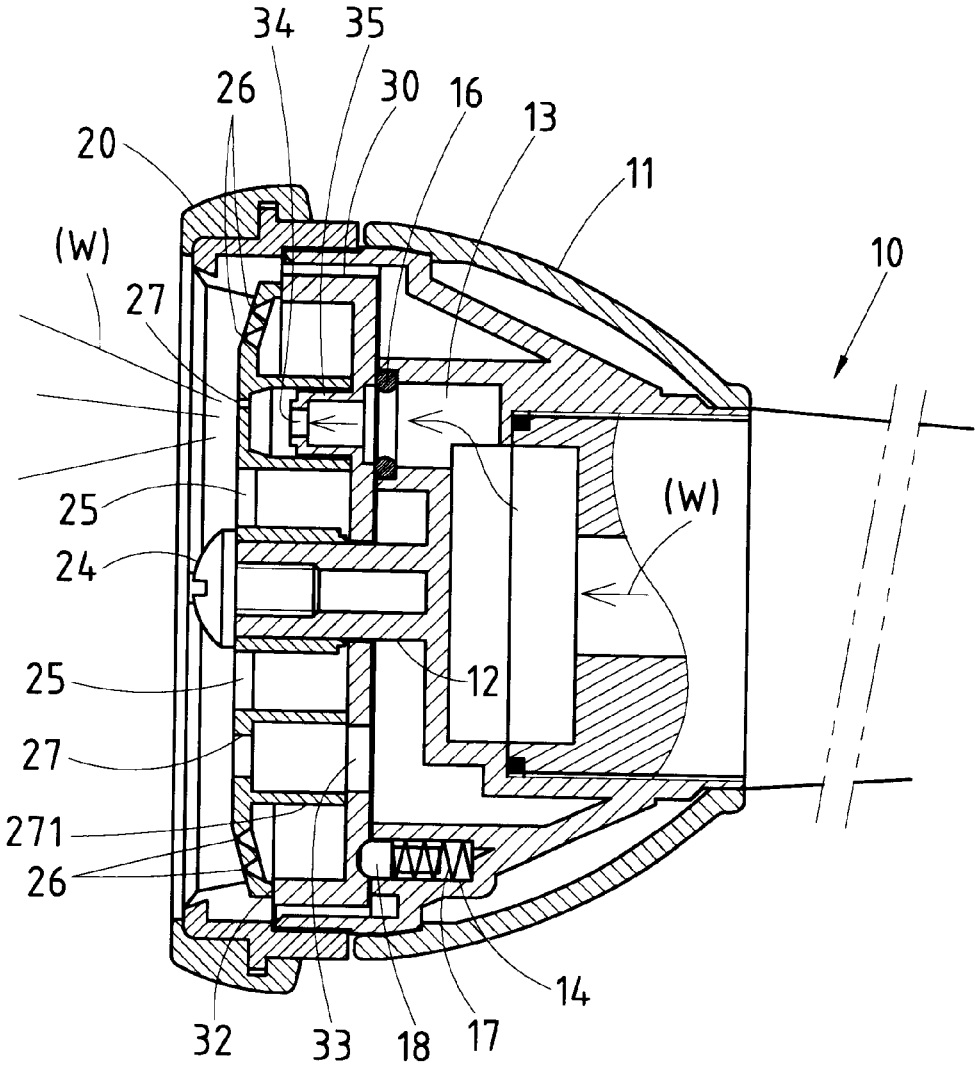
FIG. 4 shows a longitudinal sectional view of the preferred embodiment of the present invention in action.

As illustrated in FIG. 4, when the water admission hole 34 of the inner cap 30 is aligned with one of the emission holes 27 of the outer cap 20 and the water duct outlet 13 of the main body 10, the water flow "W" moves through a path which is formed by the water duct outlet 13, the water admission hole 34, and the emission hole 27. The water "W" is emitted in a specific pattern which is dependent on the structural form of the emission hole 27.

Figure 5:
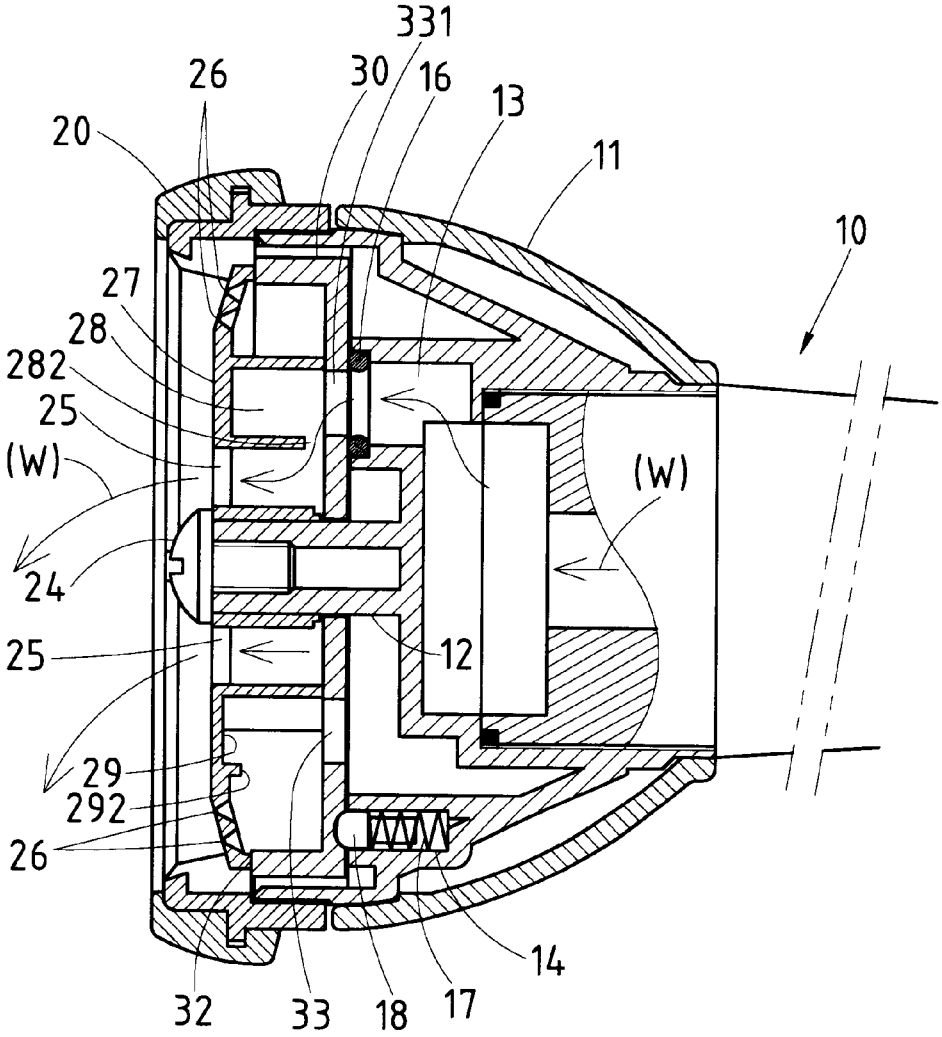
FIGS. 5 and 6 are longitudinal sectional views of the preferred embodiment of the present invention at work.

As illustrated in FIG. 5, when the water admission hole 331 of the inner cap 30 is aligned with the first closing hole 28 of the outer cap 20 and the water duct outlet 13 of the main body 10, the water flow "W" moves along a path which includes the water duct outlet 13, the water admission hole 331, the second closing hole 28, the indentation 282 of the second closing hole 28, and the central discharge holes 25 of the outer cap 20. The water is emitted in a gentle pattern.

Figure 6:
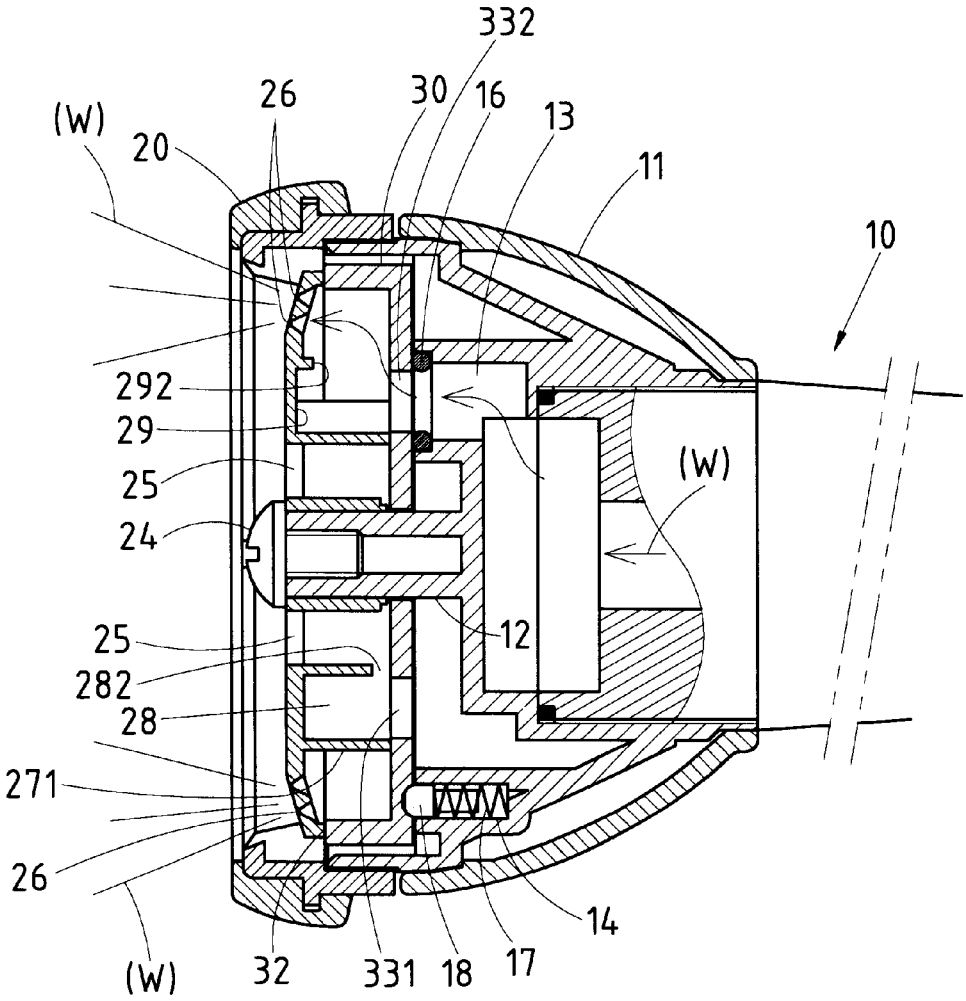

As illustrated in FIG. 6, when the admission hole 332 of the inner cap 30 is aligned with the second closing hole 29 of the outer cap 20 and the water duct outlet 13 of the main body 10, the water flow "W" moves along a path comprising the water duct outlet 13, the water admission hole 332, the second closing hole 29, and the cut 292 of the hollow pillar 291 of the second closing hole 29. The water "W" is finally emitted by the mesh holes 26 in the form of a spray.

The embodiment of the present invention described above is to be regarded in all respects a's being illustrative and nonrestrictive. Accordingly, the present invention may be embodied in other specific forms without deviating from the spirit thereof. The present invention is therefore to be limited only by the scope of the following claim.

I claim:

1. A sprinkler nozzle comprising:

a main body having a head which is comprised of a fastening rod, a water duct outlet, and a locating hole, said locating hole being provided therein with a spring and an urging pin;

an outer cap comprised of a plurality of ribs which are arranged in a radiating pattern for connecting a disk which is provided with a through hole corresponding in location to said fastening rod of said main body, said outer cap being fastened to said head of said main body such that said fastening rod of said main body is put through said through hole of said disk of said outer cap, said disk further comprised of a plurality of central discharge holes circumventing said through hole, a number of mesh holes located in a peripheral area of said disk, a plurality of emission holes various in form and located between said mesh holes and said central discharge holes, a first closing hole, and a second closing hole, said first closing hole and said second closing hole being located between said mesh holes and said central discharge holes, said emission holes being provided with a hollow pillar extending therefrom, said first closing hole being provided with a hollow pillar extending therefrom and having an indentation in communication with said central discharge holes, said second closing hole being provided with a hollow pillar extending therefrom and having a cut in communication with said mesh holes, said through hole of said disk of said outer cap further provided with a stepped pillar extending therefrom; and an inner cap comprised of a through hole and disposed between said head of said main body and said outer cap such that said stepped pillar of said outer cap is put through said through hole of said inner cap, such that an outer edge of a front side of said inner cap is rested against a fringe of the peripheral area of said disk of said outer cap, and such that the outer edge of the front side of said inner cap is separated from said ribs of said outer cap by a predetermined distance, said inner cap being further comprised of a plurality of water admission holes corresponding in location to said emission holes and said closing holes of said outer cap, one of said water admission holes being provided with a protruded tube extending to join with the hollow pillar of one of said emission holes, said one of said emission hole being corresponding in location to said one of said water admission holes, thereby enabling said inner cap and said outer cap to move synchronously, said inner cap further comprised of, in a periphery, a plurality of locating slots for locating said urging pin of said locating hole of said main body so as to locate said outer cap and said inner cap at the time when one of said water admission holes of said inner cap is aligned with said water duct outlet of said head of said main body.

* * * * *